United States Patent [19]

Randisi

[11] 4,396,514

[45] Aug. 2, 1983

[54] LUBRICATING COMPOSITION AND METHOD FOR MAKING

[76] Inventor: Sal A. Randisi, 129 Autumn Dr., Hauppauge, N.Y. 11787

[21] Appl. No.: 345,931

[22] Filed: Feb. 4, 1982

Related U.S. Application Data

[63] Continuation-in-part of Ser. No. 265,648, May 20, 1981, abandoned.

[51] Int. Cl.[3] ..... C10M 1/30; C10M 1/10

[52] U.S. Cl. ..... 252/30; 252/28

[58] Field of Search ..... 252/28, 30

[56] References Cited

U.S. PATENT DOCUMENTS 3,453,210 7/1969 Wright ..... 252/28
3,639,237 2/1972 Curtis ..... 252/28
3,770,633 11/1973 Holley et al. ..... 252/28
3,793,197 2/1974 Chapman ..... 252/28
3,856,686 12/1974 Sato et al. ..... 252/28

*Primary Examiner*—Jacqueline V. Howard
*Attorney, Agent, or Firm*—Stephen E. Feldman; Marvin Feldman; Jules L. Chaboty

[57] ABSTRACT

A lubricating composition is provided which is a stable dispersion of a lubricating fluid such as a natural or synthetic petroleum distillate, and a finely divided polymeric fluorocarbon powder such as polytetrafluoroethylene such as Teflon and a silicon dioxide powder such as a fumed silica. The composition is best provided by utilization of a disc impeller at elevated temperature to attain a moisture-free, even dispersion of the Teflon and the silica in the fluid. The lubricating composition is particularly useful in wide temperature range service, particularly so at extremely high and low temperatures.

19 Claims, 5 Drawing Figures

FIG. 1
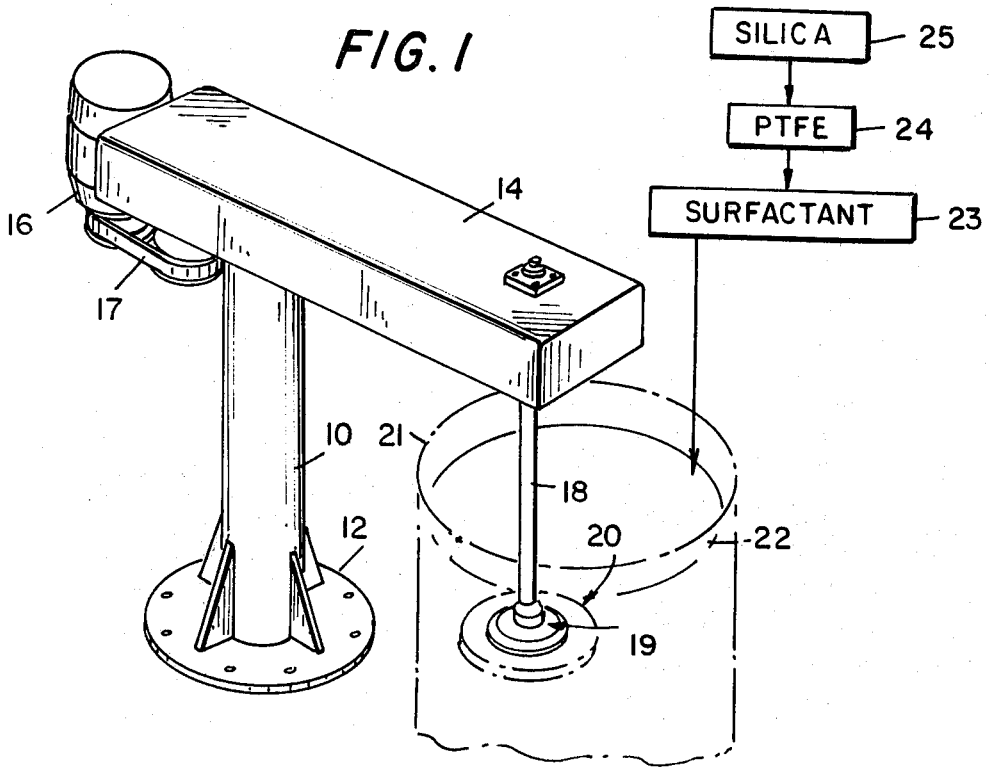
FIG. 2
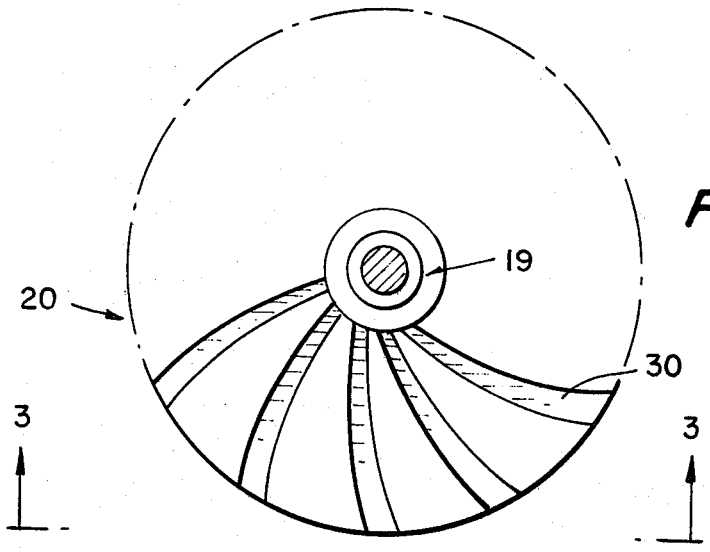
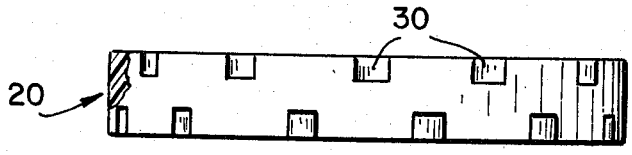
FIG. 3

LUBRICATING COMPOSITION AND METHOD FOR MAKING

RELATED PRIOR U.S. PATENT APPLICATIONS

This application is a continuation-in-part of Ser. No. 265,648, filed May 20, 1981, and now abandoned.

FIELD OF THE INVENTION

This invention relates to lubricating compositions. More specifically, this invention relates to thickened lubricants containing polymeric fluorocarbons and an improved method for making such lubricants.

BACKGROUND AND DISCUSSION OF THE PRIOR ART

It was known in the prior art to combine various oils and greases with powders of polymeric fluorocarbons in order to positively increase the lubricating quality and durability of the lubricant. U.S. Pat. No. 3,664,956 granted May 3, 1972 to Messina, et al, discloses a lubricant comprising polytetrafluoroethylene in combination with polysiloxanes and a grease composition.

Typically, these oil and grease based lubricants contained other additives in addition to polymeric fluorocarbons so as to create or improve a characteristic of the lubricating composition.

For instance, U.S. Pat. No. 4,224,173 granted Sept. 23, 1980 to Reick, discloses the use of a lubricating oil containing polytetrafluoroethylene (PTFE) particles and a fluorochemical surfactant for stabilizing the oil-PTFE dispersion and reducing volatilization losses during use of the lubricant in an internal combustion engine.

In U.S. Pat. No. 3,723,317 granted Mar. 27, 1973 to Ulery, lubricating greases are disclosed which comprise a fluorinated polyesther, a base oil, PTFE and a triazine compound for improving anti-corrosive and air oxidation resistance qualities of the lubricant.

The prior art in U.S. Pat. No. 3,933,656 granted Jan. 20, 1976 to Rick, also discloses a lubricant comprising a base oil intermixed with a dispersion of PTFE particles and a silane which, acting as a charge neutralizing compound, prevents a clumping together of the PTFE particles in suspension.

In order to enable the lubricant dispersions to retain their structural integrity and stability under extreme pressure and temperature and sheer stress conditions and to prevent the settling out of suspended particles such as PTFE, the prior art typically added thickeners such as fatty acid soaps, metal salts, mineral diatoms and organic polymers. U.S. Pat. No. 3,493,513 granted Feb. 3, 1970 to Petriello, discloses a lubricating grease and oil composition comprising a base oil, PTFE particles and a selected amount of polyethylene added as a thickener. U.S. Pat. No. 3,639,237 granted Feb. 1, 1971 to Curtis also relates to a lubricant grease which comprises a base oil, PTFE powder, and further comprises colloidal asbestos and other inorganic thickeners selected from talc, graphite and Group I, II and IV metal oxides and carbonates.

However, the grease compositions embodying these thickening agents typically fail in prolonged or excessive service or storage. Further, the metal salts in some bearing systems can be corrosive to the metallurgical entities and can cause stress cracking in plastic bearings. In addition, the mineral diatoms are frequently hygroscopic and can induce hydrolytic breakdown of the oil base and undergo bleed-out, a phenomena whereby the physical saturation or adsorption changes under bearing stress. Polyethylene while substantially resistant to hydrolytic reaction undergoes slow but relentless oxidation and crystallization under frictional wear and stress. In addition, grease containing asbestos fibers may be abrasive. Many of the thickeners used may also increase the toxicity of the lubricant within which it is used, thereby restricting its possible commercial applications.

Furthermore, many current grease-type lubricants are generally inoperable over a wide temperature range, especially at extremely low temperatures, and are thus not completely suitable for many potential commercial or military applications. For example, where lubricants do not possess physical characteristics which will permit their successful and reliable operation in equipment at extremely low temperatures, serious operational problems are introduced which often necessitates the use of auxiliary heaters to raise ambient temperatures.

It is therefore an object of this invention to provide improved lubricant compositions which are free of the abovementioned disadvantages.

It is a further object of this invention to provide an improved and uniquely different lubricant endowed with significantly greater endurance, wide service temperature range, good shear and oxidation stability and high electrical resistance, and a novel method for making the composition.

It is an additional object of this invention to provide a unique lubricant with a low toxicity and extended shelf life.

The aforesaid as well as other objects and advantages will be made more apparent in reading the following description and the adjoined claims.

BRIEF DESCRIPTION OF THE DRAWINGS

FIG. 1 is perspective of the dispersing apparatus with schematic illustration of the mixing operation of the present invention.

FIG. 2 is an enlarged plan view of an impeller disc illustrating the arrangement of grooves on the face of the disc.

FIG. 3 is an edge elevational view of the impeller of FIG. 2 along line 3—3.

SUMMARY OF THE INVENTION

Figure 4:
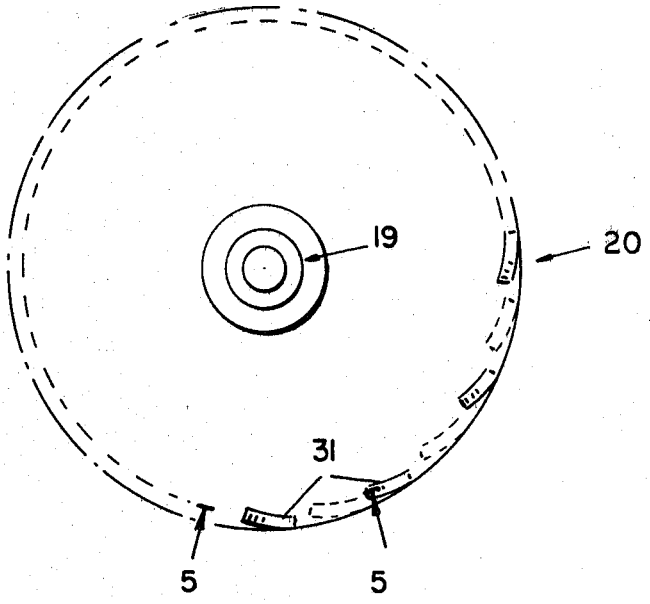
FIG. 4 is an enlarged plan view of an impeller disc illustrating the arrangement of the teeth on the edge of the disc.

It has now been found, in accordance with this invention, that by incorporating in a lubricating fluid, such as a natural or synthetic hydrocarbon petroleum distillate, the combination of (1) a finely divided polymeric fluorocarbon such as polytetrafluoroethylene particulates and (2) a silicon dioxide inorganic thickener, an improved lubricant results. It has also been found that utilization of a disc inpeller at temperatures of 105° F. to 125° F. provides a moisture-free, fixotropic dispersion of the particulates in the fluid.

DESCRIPTION OF THE PREFERRED EMBODIMENTS

Broadly speaking, the lubricating composition of the present invention comprises a stable dispersion of a lubricating fluid, a polymeric fluorocarbon and a silicon dioxide.

This lubricating composition may be used in any system which now uses ordinary lubricants.

More specifically, the lubricating fluid of this invention may comprise a natural petroleum distillate including various grades of grease and oil and/or may also comprise a synthetic petroleum distillate or synthesized hydrocarbon. The synthesized hydrocarbons preferred for use in this invention are low molecular weight saturated polyalphaolefins and hydrogenated oligomers of short chain normal alphalolefins. These synthetic hydrocarbon lubricating fluids are readily available commercial commodities. They are marketed by Uniroyal under the trade name "Uniroyal PAO" and by Gulf Petrochemicals under the tradename "Synfluid." both fluids are available in different grades or weights. It is preferred for this invention a blend of about 6 and 40 weight oil be used. It is also contemplated that these synthetic hydrocarbons may be used in the practice of this invention either purely by themselves or intermixed with natural petroleum distillates.

The use of these synthetic fluids insures a highly pure lubricating fluid which additionally helps conserve shrinking world supplies of natural peroleum reserves. The lubricating fluid of this invention comprises from about 50% to about 95% of the lubricating composition. The remainder of the composition comprises the polymeric fluorocarbon and silicon dioxide and may also comprise additional additives.

Any polymeric fluorocarbon powder can be used in this invention provided it is characterized by a high melting point, i.e., above 450° F., and consists of finely divided particles whose average size ranges from submicron (e.g., about 0.1 micron) to 100-micron size. Preferably, these particles will have an average particle size of about 0.7 microns. Preferred are the polymeric fluorocarbons selected from the group consisting of polytetrafluoroethylene (TFE) and fluorinated ethylene propylene (FEP) copolymer. The polymeric fluorocarbon compounds operable in this invention may be purchased as readily available commercial commodities under such trade names as "TFE Teflon" and "FEP Teflon." The polytetrafluoroethylene is a polymer of a fully fluorinated hydrocarbon of the basic chemical formula ($—CF_2—CF_2—$) containing 71 percent by weight of fluorinated ethylene. The propylene copolymer is a fully fluorinated resin prepared by polymerization of tetrafluoroethylene and hexafluoropropylene to form a copolymer containing about 5 to about 50 weight percent hexafluoropropylene and about 95 to about 50 weight percent tetrafluoroethylene. These copolymers have respective melting points ranging from about 480° F. to about 560° F. Especially preferred for use in this invention is polytetrafluoroethylene (PTFE).

It is preferable that the polymeric fluorocarbon comprises from about 1% to about 3% of the lubricating composition. It is also contemplated that higher percentages will be used in the practice of the invention.

The silicon dioxide or fumed silica of the disclosed invention is produced from silicon tetrachloride in a flame hydrolysis process with oxygen-hydrogen gas. This process produces highly dispersed silicon dioxide of amorphous structure and great purity with controlled particle size. The finely divided fumed silica powder has particles which may range from about 7 to 40 millimicrons in size. It has also suprisingly been found that silicon dioxide particulates of such small size do not have abrasive characteristics. The preferred size particle for this invention ranges from 12–16 millimicrons. Particles of various sizes may be intermixed in the lubricating composition or may all be of approximately the same size. The fumed silica powder is a readily available commercial product of the Degussa Corporation and is marketed under the trade name "Aerosil."

The extreme thixotropic filler action of the fumed silica powder is a function of the silanol groups present on the surface of the particles in optimal density and their propensity to form hydrogen bonds. This characteristic may, in large part, account for the great stability of the dispersion comprising the lubricating composition and thereby prevent the settling out or separating the polymeric fluorocarbon powder from the lubricating fluid. Furthermore, the electrical conductivity of the fumed silica is very poor and qualifies it in effect as an insulator. Even under adverse conditions (i.e., an exceptionally high moisture content), the electrical resistivity of the fumed silica is still about $10\times10^{12}$ Ohm×cm at packed densities of 50–60 g/l. This property greatly contributes to the high electrical resistance of the lubricating composition of which it is an integral part. It is preferred that the silicon dioxide or fumed silica particles comprise from about 2% to about 10% of the lubricating composition.

The following examples are illustrative of various embodiments the lubricating composition may form.

EXAMPLE 1

| | |
|---|---|
| Polyalphaolefin Oil | 82.25% |
| Mineral Oil | 12.00% |
| PTFE | 1.00% |
| Fumed Silicate | 4.75% |
| | 100.00% |

EXAMPLE 2

| | |
|---|---|
| Polyalphaolefin Oil | 70.00% |
| Mineral Oil U.S.P. | 17.00% |
| PTFE | 3.00% |
| Fumed Silica | 9.00% |
| Polyethylene Glycol | 1.00% |
| | 100.00% |
| Color Polychrome Orange | (trace to sample) |

EXAMPLE 3

| | |
|---|---|
| Mineral Oil | 17.00% |
| Polyalphaolefin Oil | 70.00% |
| PTFE | 3.00% |
| Fumed Silicate | 9.00% |
| Polyethylene Glycol | 1.00% |
| Ashless Antioxidant | (trace to 1 lb. per 100 lbs.) |
| | 100.00% |

EXAMPLE 4

| | |
|---|---|
| Polyalphaolefin Oil | 80.00% |
| Mineral Oil | 13.75% |
| PTFE | 3.00% |
| Fumed Silicate | 2.75% |
| Antioxide | .50% |

-continued

| | |
|---|---|
| | 100.00% |

EXAMPLE 5

| | |
|---|---|
| Polyalphaolefin Oil | 45.00% |
| Mineral Oil | 13.25% |
| Alcolec "S" Emulsifier | 4.00% |
| Cationic Surfactant | 4.75% |
| Antioxidant | 1.00% |
| Attapulgite Gelling Agent | 30.00% |
| PTFE | 2.00% |
| | 100.00% |

It has surprisingly been found that the lubricating composition, as a whole, has a service temperature range from about −72° F. to about 500° F. In addition, the lubricating composition has an electrical resistance ranging from about $1\times10^{14}$ to about $2\times10^{14}$ Ohm-cm at 100 volts. Furthermore, pursuant to the ASTM D-1742 and FTM-781-B tests, the lubricating composition did not exhibit any oil separation after 365 days. The lubricating composition is also 100% water resistant according to the ASTM D-1264-500 hour test and is also USDA rated AA. In addition, it has been found that the lubricating composition may sustain a mean Hertz load from about 105–122 Kg pursuant to the extreme pressure test (four-ball method; 1P 239/77). It has also been found that the lubricating composition may be exposed to $2\times10^{8}$ RAD pursuant to the Atomic International Test—40 year equivalent, and still remain effective.

It is also within the contemplation of this invention to include small amounts of other compositions so as to compliment or further increase the lubricating compositions desirable characteristics as was detailed in the examples. Contemplated compositions include dyes, polyethylene glycol, antioxidants, cationic surfactants, rust inhibitors, emulsifiers, attapulgite gelling agents, and imidazoline oleie.

While the aforesaid composition may be formed by blending techniques well-known in the art, it has been found that utilization of a specific mixer under certain mixing parameters, as will be more fully discussed hereinafter, produces a highly superior product.

In another aspect, the present invention is the mixing of the lubricating fluid and the polymeric fluorocarbon particulates and the silica dioxide particulates with a disc impeller, at elevated temperatures of about 105° F. to 125° F., so that an eventually moisture-free, evenly dispersed lubricant composition is found. It has been found that a disc-type, high speed impeller such as is disclosed in U.S. Pat. No. 4,171,166, granted Oct. 16, 1979 to Trowbridge et al. is particularly suited to the present invention, and the disclosure in this patent is incorporated herein by reference.

Referring to FIG. 1, the representative dispersing apparatus of the invention may be seen to include a pedestal 10 having a base 12 which rests on the floor or other supporting surface, and a bridge 14 supported on the upper end of the pedestal 10 with a motor 16 mounted on one end of the pedestal and an impeller shaft 18 supported on and depending from the other end of the bridge 14. Suitable belts and other drive means 17 extend from the motor through the bridge in a known manner to rotate the impeller.

Figure 5:
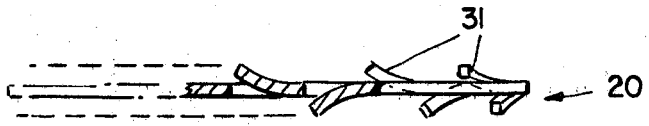
FIG. 5 is an edge elevational view of the impeller of FIG. 4 along line 5—5.

Mounted on the lower end of the impeller shaft 18 is an impeller hub assembly 19 and disc 20 which may be seen to have a generally flat circular configuration with flanged teeth on its edge as in FIGS. 4 and 5 or a grooved face as in FIGS. 2 and 3.

It has surprisingly been found that a stainless steel disc 20, not a plastic disc as disclosed in Trowbridge, is particularly effective in mixing particulates such as silicon dioxide into a viscous liquid lubricating fluid. The disc utilized herein, as shown in FIGS. 4 and 5, has a substantially planar face disposed perpendicular to its axis. The disc is preferably formed with a plurality of flanged teeth 31 disposed along its outer edge. The teeth are formed above and below the disc face in alternating fashion (every other tooth being similarly alligned with regard to the disc face). The disc may also be formed with a plurality of radially curved grooves 30 emanating from the center of the disc face as seen in FIGS. 2 nd 3.

In the mixing of the composition with the disc impeller, it has been found that by first mixing the fluid 22 neat in 55 gal. drums 21, for modest periods, the impeller friction causes the fluid temperature to rise to about 105°–125° F., preferably 112°–118° F. and optionally around 114°–116° F. Once the fluid reaches this operatory temperature, the surfactant 23 is added with continued mixing, and then added are the fluorocarbon particulates 24 and followed lastly by the addition of silica dioxide particulates 25.

It has also been found that in order to achieve the desired temperature of about 114°–116° F. it is preferable to mix the lubricating fluid and surfactant for about 20 to 30 minutes, optionally about 24 minutes. In order to maintain this temperature upon the addition of the fluorocarbon particulates it is preferable to mix the composition for another approximately 10 to 15 minutes, optionally about 12 minutes, and upon the addition of the silicon dioxide particulates to mix for about another 15 to 30 minutes, optionally 20 to 24 minutes. It is also preferable if the resultant composition is mixed for additional 1 to 1.5 hours after the addition of the silicon dioxide particulates in order to impart shear stability characteristics in the lubricating composition. Once this characteristic is imparted, the lubricating composition will remain fixotropic and its components will not separate during use. The total mixing time preferred for the manufacture of the lubricating composition is about 2 hours.

It is contemplated that this invention will prove highly useful in any mechanical operation, especially those which utilize relatively moving parts such as automobiles, home appliances, marine equipment, sporting equipment, ski lifts, manufacturing equipment, construction equipment, baking equipment and a multitude of others.

In the specification herein, there has been set forth preferred embodiments of the invention, and although specific terms are employed, they are used in a generic and descriptive sense only and not for purposes of limitation.

Inasmuch as many changes could be made in the above construction, and many apparently different embodiments of the invention could be made without departing from the scope thereof, it is intended that all matters contained in the above description shall be intepreted as illustrative and not in a limiting sense.

What is claimed is:

1. A lubricating composition useful for wide temperature range service, said lubricating composition having a service temperature range from about −72° F. to about 500° F. and an electrical resistance ranging from about $1\times10^{14}$ Ohm-cm to about $2\times10^{14}$ Ohm-cm at 100 volts, said lubricating composition comprising a stable dispersion of:

a. a hydrocarbon lubricating liquid, said hydrocarbon liquid comprising from about 50% to about 95% of said lubricating composition;

b. a finely divided polymeric fluorocarbon powder comprising polytetrafluoroethylene in the form of a finely divided powder with particles ranging from about 0.1 to 100 microns in size and having a melting temperature above 450° F., said polymeric fluorocarbon powder comprising from about 1% to about 3% of said lubricating composition, and;

c. a silicon dioxide in the form of a finely divided fumed silica powder with particles ranging from about 7 to about 40 millimicrons in size, said silicon dioxide comprising from about 2% to about 10% of said lubricating composition.

2. The lubricating composition of claim 1, wherein the fumed silica is evenly dispersed within the lubricating liquid and polymeric fluorocarbon powder.

3. The lubricating composition of claim 2, wherein the lubricating liquid is a petroleum distillate.

4. The lubricating composition of claim 2, wherein the lubricating liquid is synthesized hydrocarbon.

5. The lubricating composition of claim 2, wherein the lubricating liquid comprises a petroleum distillate and a synthesized hydrocarbon.

6. A method for making a lubricating composition useful for wide temperature range service, said lubricating composition being a stable dispersion and having a service temperature range from about −72° F. to about 500° F. and an electrical resistance ranging from about $1\times10^{14}$ Ohm-cm to about $2\times10^{14}$ Ohm-cm at 100 volts, said method comprising:

a. providing a hydrocarbon lubricating liquid, said hydrocarbon liquid comprising from about 50% to about 95% of said lubricating composition;

b. adding and mixing into said hydrocarbon liquid finely divided polymeric fluorocarbon particulates in a first mixing step, said polymeric fluorocarbon particulates comprising polytetrafluoroethylene in the form of a finely divided powder with particles ranging from about 0.1 to 100 microns in size and having a melting temperature above 450° F., said polymeric fluorocarbon powder comprising from about 1% to about 3% of said lubricating composition, and c. subsequently adding to the hydrocarbon liquid-polymeric fluorocarbon powder mixture produced by step (b), and mixing into said mixture in a second mixing step, finely divided silicon dioxide particulates in the form of a finely divided fumed silica powder with particles ranging from about 7 to about 40 millimicrons in size, said silicon dioxide particulates comprising from about 2% to about 10% of said lubricating coposition;

said first and second mixing steps being carried out by contacting said components with a rotating disc impeller, so as to provide evenly dispersed particulates of both said polymeric fluorocarbon powder and said silicon dioxide powder in said hydrocarbon lubricating liquid.

7. The method of claim 6, further comprising adding a surfactant to the liquid and then adding the particulates to the liquid.

8. The method of claim 7, wherein the polymeric fluorocarbon particulates comprising polytetrafluoroethylene are added prior to adding the silicon dioxide particulates.

9. The method of claim 6, wherein said disc has flanged teeth.

10. The method of claim 6, wherein said liquid is first mixed to a temperature of about 105° F. to 125° F., and then the particulates are added.

11. The method of claim 10, further comprising adding a surfactant to the fluid and then adding the particulates to the fluid.

12. The method of claim 10, wherein said temperature is about 112° to 118° F.

13. The method of claim 10, wherein the temperature is achieved through friction of the disc action in the liquid.

14. The method of claim 10, wherein the mixing at said temperature provides an essentially moisture-free liquid.

15. The method of claim 6, wherein said disc further comprises radially curved grooves.

16. The method of claim 7, wherein the lubricating liquid, surfactant, polymeric fluorocarbon particulates and silicon dioxide particulates are mixed for a total of about 2 hours to provide the lubricating composition.

17. The method of claim 16, wherein the mixing for that time provides a fixotropic composition.

18. The method of claim 16, wherein the lubricating liquid and surfactant are mixed for about 20 to 30 minutes.

19. The method of claim 18, wherein the lubricating liquid, surfactant and polymeric fluorocarbon particulates are mixed for about 10 to 15 minutes.

* * * * *